United States Patent [19]

Braun et al.

[11] Patent Number: 5,002,341

[45] **Date of Patent: * Mar. 26, 1991**

[54] MINING APPARATUS FOR MECHINIZED BREAKING-DOWN OF MINERAL MATERIALS, PARTICULARLY COAL, IN UNDERGROUND MINING OPERATIONS

[75] Inventors: Gert Braun; Ernst Braun, both of Essen-Heisingen, Fed. Rep. of Germany

[73] Assignee: Halbach & Braun Industrieanlagen, Fed. Rep. of Germany

[ * ] Notice: The portion of the term of this patent subsequent to May 1, 2007 has been disclaimed.

[21] Appl. No.: 410,989

[22] Filed: Sep. 22, 1989

Related U.S. Application Data

[63] Continuation-in-part of Ser. No. 268,088, Nov. 7, 1988, Pat. No. 4,921,307.

[30] Foreign Application Priority Data

Oct. 15, 1988 [DE] Fed. Rep. of Germany ..... 3835219

[51] Int. Cl.[5] ..... E21C 29/16; F16H 55/22

[52] U.S. Cl. ..... 299/34; 475/7

[58] Field of Search ..... 299/1, 29, 34, 48; 475/5, 7, 317, 329

[56] References Cited

U.S. PATENT DOCUMENTS

| | | | |
|---|---|---|---|
| 1,594,394 | 8/1926 | Weston | 475/7 X |
| 2,422,343 | 6/1947 | Duer | 475/7 |
| 3,364,789 | 1/1968 | Whitfield | 475/7 |

*Primary Examiner*—Ramon S. Britts
*Assistant Examiner*—David J. Bagnell
*Attorney, Agent, or Firm*—Toren, McGeady & Associates

[57] ABSTRACT

A mining apparatus for coal with an endless chain revolving around chain wheels. A main drive is provided for one of the chain wheels and an auxiliary drive is provided for the other chain wheel. A transmission stage of the auxiliary drive is a superposed transmission unit. A controllable superposed motor with a worm gear transmission unit acts on the superposed input of the superposed transmission unit. The worm gear transmission unit includes two drive worms which are offset relative to each other by 180° and mesh with the superposed input of the superposed transmission unit. As a result, the supporting moment load and the torque load or power distribution are cut in half, so that the worm gear transmission unit is not susceptible to trouble.

4 Claims, 2 Drawing Sheets

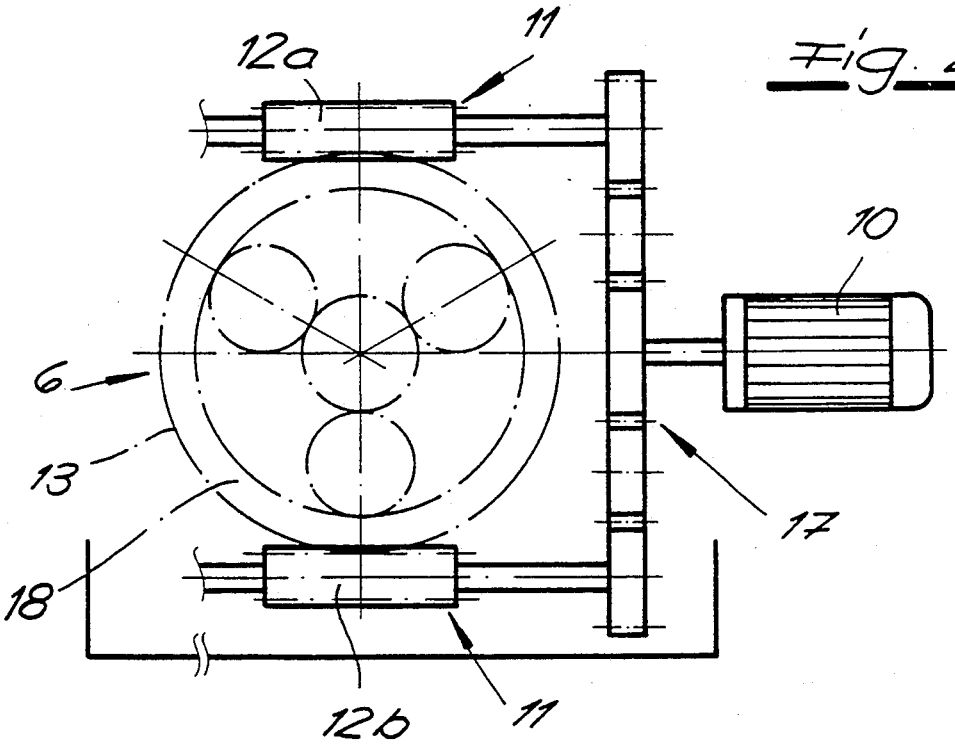
Fig. 2
Fig. 3
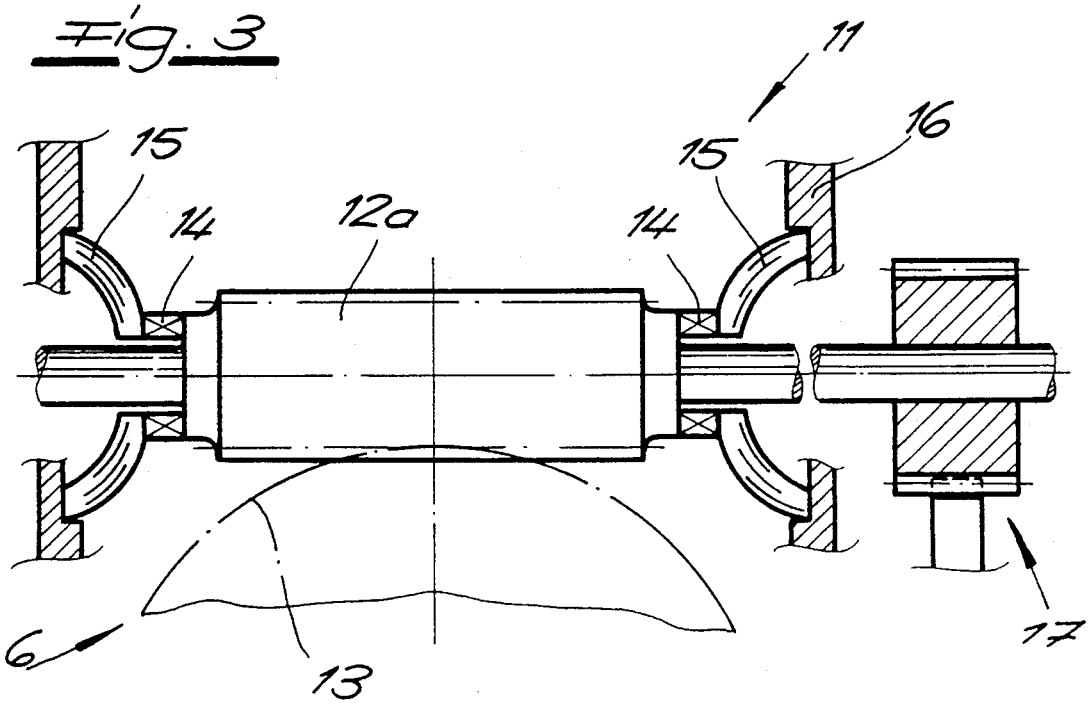

MINING APPARATUS FOR MECHINIZED BREAKING-DOWN OF MINERAL MATERIALS, PARTICULARLY COAL, IN UNDERGROUND MINING OPERATIONS

This is a continuation-in-part application of U.S. application Ser. No. 07/268,088, filed Nov. 7, 1988, now U.S. Pat. No. 4,921,307.

BACKGROUND OF THE INVENTION

1. Field of the Invention

The present invention relates to a mining apparatus for the mechanized breaking-down of mineral raw materials, particularly coal, in underground mining operations. The mining apparatus includes at least one revolving endless chain and chain wheels for the endless chain at the revolving ends of the chain. A main drive is provided for one of the chain wheels and an auxiliary drive is provided for the other chain wheel. The main drive and the auxiliary drive each have a transmission unit including main transmission stage, initial transmission stage, coupling and drive motor. The initial transmission stage of only one of the auxiliary drive or of the main drive is constructed as a superposed transmission unit. A superposed motor constructed as a controllable electric motor having a small power is connected to a superposed input of only this superposed transmission unit. An auxiliary transmission unit in the form of a worm gear transmission is arranged between the superposed transmission unit and the superposed motor.

2. Description of the Related Art

In mining apparatus of the above-described type it is desired that the drive motors of main drive and auxiliary drive run synchronously because only a synchronous running ensures a uniform load or maximum power of main drive and auxiliary drive. The above-described mining apparatus, or its drive control, is described and claimed in applicants' pending application Ser. No. 07/268,088 filed Nov. 7, 1988, now U.S. Pat. No. 4,921,307, and is used to avoid overloading of either the main drive or the auxiliary drive.

Thus, in accordance with this mining apparatus, only a unilateral control of either the auxiliary drive or of the main drive with the use of a single superposed transmission unit and a single superposed motor, i.e., an electric motor having small power, is necessary. Nevertheless, a synchronous running of the two drive motors is ensured. As a result, with respect to the two chain wheels, a uniform load of the two drive motors and, consequently, a uniform distribution of the load to the chain wheels or the endless chain are obtained. In the above-described mining apparatus, the rate of rotation of the motor can be increased or decreased during synchronization.

The above-described mining apparatus, or the drive system thereof, has been found very useful, however, further improvements are possible. This is because when the mining apparatus operates, inevitably impact and percussion-type loads occur which emanate from the mining device, for example, a coal planing device, and which are transmitted on the driven side into the controlled auxiliary drive (or the main drive). Such impact and percussion-type loads are eventually transmitted to the worm gear transmission unit and there must be absorbed by the drive worm which laterally meshes with the superposed transmission unit. In extreme cases, this may lead to damage of the worm gear transmission unit or of the drive worm thereof and may consequently lead to interruptions in the operation of the mining apparatus.

It is, therefore, the primary object of the present invention to provide a mining apparatus for the mechanized breaking-down of mineral raw materials, particularly coal, in underground mining operations, in which the above-described disadvantages are eliminated. In addition, it is to be safely avoided that damage occurs to the worm gear transmission unit or the drive worm thereof due to impact or percussion-type loads introduced at the driven side, so that the operation of the auxiliary transmission unit is completely trouble free.

SUMMARY OF THE INVENTION

In accordance with the present invention, in a mining apparatus of the above-described type, the worm gear transmission unit meshes with the superposed input of the superposed transmission unit through two drive worms which are offset by 180° and extend parallel to each other, so that the supporting moment load and the torque load acting on the worm gear transmission unit are cut in half.

The measures according to the present invention provide the result that, with respect to the impact and percussion-type loads introduced on the driven side into the auxiliary transmission unit or worm gear transmission unit, a distribution of the supporting moment to both drive worms is obtained. In addition, a torque distribution to both drive worms is achieved on the driven side. This results in half the load acting on the auxiliary transmission unit or worm gear transmission unit on the drive side and on the driven side. Consequently, the worm gear transmission unit is practically no longer susceptible to trouble, or the susceptibility to trouble is at least minimized, so that it no longer has to be expected that damage will occur to the auxiliary transmission unit or worm gear transmission unit or the drive worms thereof due to impact and percussion-type loads introduced on the driven side. The same is true for the load on the drive side with respect to the control of the synchronous running of the auxiliary drive and the main drive.

In accordance with an important further feature of the present invention, the two drive worms are mounted in thrust bearings or axial bearings and are supported on both sides by means of sets of springs in axial direction relative to the bearing housing or an appropriate fixed point. As a result, damping is achieved in the region of engagement of the drive worms.

In accordance with another preferred feature of the present invention, the two drive worms are synchronously driven by the superposed motor or electric motor with the intermediate arrangement of a wheel gear transmission unit with gear differentials, so that an identically equal distribution of power is achieved at the drive side.

In order to avoid harmful play between the pinions of the two drive worms and the corresponding wheel gear transmission units, one of the drive worms can be in engagement through a gear differential at the top and the other drive worm can be in engagement at the bottom in the transmission sump with the hollow wheel of a superposed transmission unit in the form of a planetary gear transmission. When the worms are arranged symmetrically in this manner, an excellent lubrication of the drive worm in the transmission sump is achieved and, through the hollow wheel, the upper drive worm is also lubricated.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

FIG. 2 is a schematic partial view of the superposed input of the superposed transmission unit including drive worms, wheel gear transmission unit and superposed motor; and FIG. 3 is a schematic view, on a larger scale, of the bearing of a drive worm for the pinion on the bearing shaft.

DESCRIPTION OF THE PREFERRED EMBODIMENT

Figure 1:
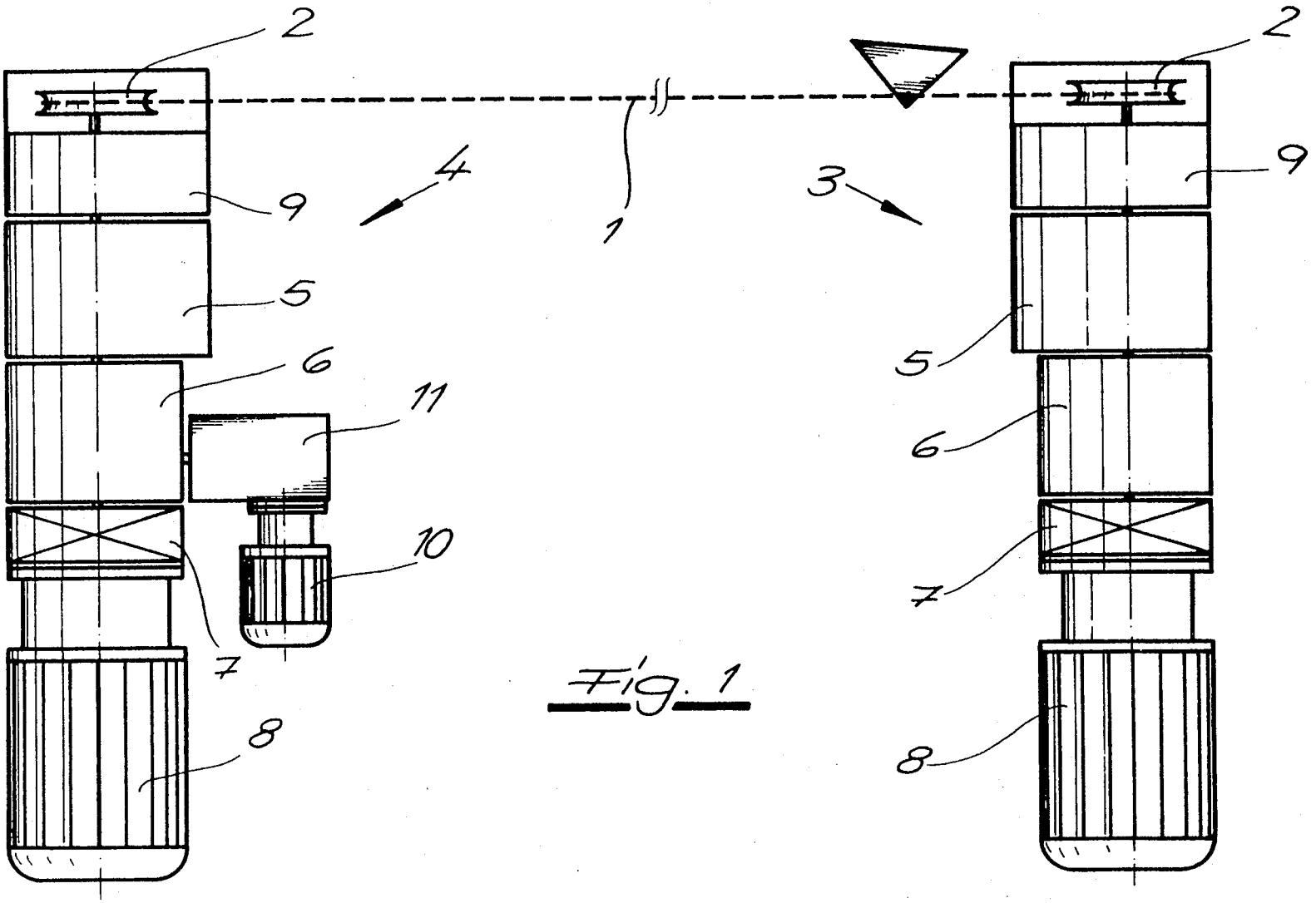
FIG. 1 schematically shows a mining apparatus with a drive control according to the present invention.

The figures of the drawing show a mining apparatus for the mechanized breaking-down of mineral raw materials, particularly coal, in underground mining operations. The apparatus includes a revolving endless chain 1 and chain wheels 2 for the endless chain 1 which revolves at its ends at the chain wheels 2. A main drive 3 is provided for one of the chain wheels and an auxiliary drive 4 is provided for the other chain wheel. The drives 3 and 4 each have a transmission unit composed of main transmission stage 5, initial transmission stage 6, coupling 7 and drive motor 8.

In the illustrated embodiment, the mining apparatus is a planing unit and, thus, the endless chain 1 is a planing chain. The drive motors 8 are asynchronous motors. Between each main transmission stage 5 and each chain wheel 2 is arranged a planing drive 9 with a star-type bolt coupling which can separate the rotating masses directly at the chain wheel 2. Only the initial transmission stage 6 of the auxiliary drive 3 is a superposed transmission unit. A superposed motor 10 in the form of a controllable electric motor with a small power acts on the superposed input of only this superposed transmission unit 6.

An auxiliary transmission unit in the form of a worm gear transmission 11 is arranged between the superposed transmission unit 6 in the form of a planetary gear transmission and the superposed motor 10. The superposed motor 10 has a power of 7.5 to 15 kW, preferably 10 kW. The superposed motor 10 is frequency-controlled in dependence upon the rate of rotation of the motor of the main drive. The superposed motor 10 can also be controlled in a different manner.

The worm gear transmission unit 11 meshes with the superposed input 13 of the superposed transmission unit 6 through two drive worms **12*a*, 12*b* which are arranged offset by 180° and extend parallel relative to each other. Both drive worms 12*a*, 12*b* are supported in thrust bearings 14 and rest by means of sets of springs 15 in axial direction against the bearing housing 16 which is only partially illustrated. The two drive worms 12*a*, 12*b* are synchronously driven by the superposed motor 10 with the intermediate arrangement of a wheel gear transmission unit 17 with gear differential. Drive worm 12*a* engages the top of a hollow gear wheel 18 of the superposed transmission unit 6 constructed as a planetary gear transmission. The other drive worm 12*b* engages the bottom of the hollow gear wheel 18** in the gear unit sump.

While a specific embodiment of the invention has been shown and described in detail to illustrate the application of the inventive principles, it will be understood that the invention may be embodied otherwise without departing from such principles.

We claim:

1. In a mining apparatus for the mechanized breaking-down of mineral raw materials, particularly coal, in underground mining operations, the mining apparatus including at least one revolving endless chain and chain wheels for the endless chain at the revolving ends of the chain, a main drive being provided for one of the chain wheels and an auxiliary drive being provided for the other chain wheel, the main drive and the auxiliary drive each having a transmission unit including a main transmission stage, an initial transmission stage, a coupling connected to the transmission and a drive motor, the initial transmission stage of one of the auxiliary drive and of the main drive being a superposed transmission unit, a superposed motor constructed as a controllable electric motor having a small power being connected to a superposed input of the superposed transmission unit, an auxiliary transmission unit in the form of a worm gear transmission being arranged between the superposed transmission unit and the superposed motor, the improvement comprising the worm gear transmission unit meshing with the superposed input of the superposed transmission unit through two drive worms which are offset by 180° and extend parallel to each other, such that the supporting moment load and the torque load acting on the worm gear transmission unit are cut in half.

2. The mining apparatus according to claim 1, wherein the two drive worms each have two ends and are mounted in a thrust bearing having a housing, the drive worms being supported on both ends by means of sets of springs in axial direction relative to the bearing housing.

3. The mining apparatus according to claim 1, wherein a wheel gear transmission unit with gear differentials is arranged between the drive worms and the superposed motor, the two drive worms being synchronously driven by the superposed motor.

4. The mining apparatus according to claim 1, wherein the superposed transmission unit is a planetary gear transmission including a hollow wheel having a top and a bottom, the planetary gear transmission including a transmission sump, one of the drive worms being in engagement with the hollow wheel at the top thereof and the other drive worm being in engagement with the hollow wheel at the bottom thereof in the transmission sump.

* * * * *